US006412896B2

(12) United States Patent
Takahashi et al.

(10) Patent No.: US 6,412,896 B2
(45) Date of Patent: Jul. 2, 2002

(54) INK JET APPARATUS, INK JET APPARATUS DRIVING METHOD, AND STORAGE MEDIUM FOR STORING INK JET APPARATUS CONTROL PROGRAM

(75) Inventors: Yoshikazu Takahashi; Masaharu Ito, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/841,830

(22) Filed: Apr. 26, 2001

Related U.S. Application Data

(63) Continuation-in-part of application No. 09/200,986, filed on Nov. 30, 1998, now Pat. No. 6,257,686.

(30) Foreign Application Priority Data

Dec. 16, 1997 (JP) ..... 9-346721
Apr. 26, 2000 (JP) ..... 2000-125584

(51) Int. Cl.[7] ..... B41J 29/38
(52) U.S. Cl. ..... 347/11; 347/9; 347/10
(58) Field of Search ..... 347/9–11, 14, 347/68–69

(56) References Cited

U.S. PATENT DOCUMENTS 4,879,568 A 11/1989 Bartky et al.
4,887,100 A 12/1989 Michaelis et al.
5,028,936 A 7/1991 Bartky et al.

FOREIGN PATENT DOCUMENTS

JP 403222750 A * 10/1991 ..... 347/10
JP 405155010 A * 6/1993 ..... 347/11
JP 11-170514 A 6/1999

* cited by examiner

*Primary Examiner*—John Barlow
*Assistant Examiner*—An H. Do
(74) *Attorney, Agent, or Firm*—Oliff & Berridge, PLC

(57) ABSTRACT

When a dot is formed apart from other dots on a print medium, in response to a discontinuous print command, a first drive waveform is used. The first drive waveform includes an ejection pulse and an ink droplet reducing pulse for retrieving a portion of an ink droplet about to leave the nozzle. When a dot is formed to overlap other dots on a print medium, in response to one of continuous print commands, the second drive waveform is used. The second drive waveform includes an ejection pulse and an ejection stabilizing pulse for suppressing residual vibrations generated by the ejection pulse. By selectively using the first or the second drive waveform, an ink droplet smaller than 20 pl can be ejected stably even at high printing frequencies. As a result, high-quality, high-speed printing can be achieved.

17 Claims, 8 Drawing Sheets

Fig. 5

| Wb＼Wc | 0.10T | 0.15T | 0.20T | 0.25T | 0.30T | 0.35T | 0.40T |
|---|---|---|---|---|---|---|---|
| 0.30T | × | × | × | × | × | × | × |
| 0.35T | × | △ | △ | △ | △ | △ | × |
| 0.40T | × | △ | ○ | ○ | ○ | △ | × |
| 0.45T | × | △ | ○ | ○ | ○ | △ | × |
| 0.50T | × | △ | ○ | ○ | ○ | △ | × |
| 0.55T | × | △ | ○ | ○ | ○ | △ | × |
| 0.60T | × | △ | ○ | ○ | ○ | △ | × |
| 0.65T | × | △ | △ | △ | △ | △ | × |
| 0.70T | × | × | × | × | × | × | × |

Wa=1.0T

UP TO 7.5 kHz ○:STABLE EJECTION △:CURVED EJECTION ×:SPLASHY EJECTION

Fig. 6

| We＼Wf | 0.10T | 0.15T | 0.20T | 0.25T | 0.30T | 0.35T | 0.40T |
|---|---|---|---|---|---|---|---|
| 1.85T | × | × | × | × | × | × | × |
| 1.90T | × | × | × | × | × | × | × |
| 1.95T | × | △ | △ | △ | △ | △ | × |
| 2.00T | × | △ | ○ | ○ | ○ | △ | × |
| 2.05T | × | △ | ○ | ○ | ○ | △ | × |
| 2.10T | × | △ | ○ | ○ | ○ | △ | × |
| 2.15T | × | △ | ○ | ○ | ○ | △ | × |
| 2.20T | × | △ | ○ | ○ | ○ | △ | × |
| 2.25T | × | △ | △ | △ | △ | △ | × |
| 2.30T | × | × | × | × | × | × | × |
| 2.35T | × | × | × | × | × | × | × |

Wd=0.5～0.7T

10～15 kHz ○:STABLE EJECTION △:CURVED EJECTION ×:SPLASHY EJECTION

Fig. 7

| IMMEDIATELY BEFORE | IMMEDIATELY AFTER | DRIVE WAVEFORM |
|---|---|---|
| NO EJECTION | NO EJECTION | DRIVE WAVEFORM 1 |
| EJECTION PERFORMED | NO EJECTION | DRIVE WAVEFORM 2 |
| NO EJECTION | EJECTION PERFORMED | DRIVE WAVEFORM 2 |
| EJECTION PERFORMED | EJECTION PERFORMED | DRIVE WAVEFORM 2 |

INK JET APPARATUS, INK JET APPARATUS DRIVING METHOD, AND STORAGE MEDIUM FOR STORING INK JET APPARATUS CONTROL PROGRAM

This Application is a Continuation-in-Part of application Ser. No. 09/200,986, filed Nov. 30 1998 and allowed Feb. 22, 2001, now U.S. Pat. No. 6,257,686 the disclosure of which is incorporated by reference herein.

BACKGROUND OF THE INVENTION

1. Field of Invention

The invention relates to an ink jet apparatus, an ink jet apparatus driving method, and a storage medium for storing an ink jet apparatus control program.

2. Description of Related Art

In conventional ink jet apparatuses, the volumetric capacity of an ink channel is changed by deformation of piezoelectric ceramic. When the volumetric capacity is reduced, ink in the ink channel is ejected as an ink droplet from a nozzle and, when the volumetric capacity is increased, ink flows into the ink channel from an ink guide port. In a printhead of this kind of ink jet apparatus, a plurality of ink channels are formed and separated by piezoelectric ceramic sidewalls. An ink supplying means, such as an ink cartridge, is connected to one end of each ink channel, and an ink ejection nozzle (hereinafter referred to as a nozzle) is provided for the other end of each ink channel. Selective reductions of the volumetric capacity of the ink channels by deformation of the sidewalls, according to print data, cause ink droplets to be ejected from the corresponding nozzles onto a print medium and, as a result, characters and graphics are printed thereon.

Ink jet apparatuses of this kind, i.e., drop-on-demand type ink jet heads which eject ink droplets for printing, are becoming widespread because of their excellent ejection efficiency and low running costs.

Conventionally, in this kind of the ink jet head, there has been a need to minimize the volume of an ink droplet to be ejected for high-quality printing, such as photographic printing. As one of the attempts to reduce the ink droplet, a driving method using an ejection pulse and a droplet reducing pulse has been adopted. After applying an ejection pulse to eject an ink droplet, a droplet reducing pulse is applied to retrieve a portion of the ink droplet, which is about to be ejected, into the ink channel.

However, in such a driving method, because pressure waves remaining in the ink channel are not suppressed, ejection of a minute ink droplet may become unstable or unwanted or no ink ejection may be caused when the ink jet head is driven at high printing frequencies and, as a result, print quality deteriorates.

SUMMARY OF THE INVENTION

In view of the forgoing problem, the invention provides an ink jet apparatus. an ink jet apparatus driving method, and a storage medium for storing an ink jet apparatus control program that ensure stable ejection of an ink droplet smaller than or equal to 20 pl (picoliters) to form a dot during printing at high frequencies and thereby achieve high-speed and high-quality printing.

According to one aspect of the invention, a method of driving an ink jet apparatus is provided. The ink jet apparatus includes a nozzle from which an ink droplet is ejected, an ink channel filled with ink and connected to the nozzle, an actuator that changes a volumetric capacity of the ink channel to generate a pressure wave in the ink channel, and a controller that applies an ejection pulse signal to the actuator to cause ink droplet ejection from the nozzle. By the ink jet apparatus driving method, which is applied when an ink droplet smaller than or equal to 20 pl in volume is ejected to form a dot, an ejection pulse signal having a first drive waveform or an ejection pulse signal having a second drive waveform is selectively used to form a dot. An ejection pulse signal having the first drive waveform is used when there are no ejection commands either immediately before or after a dot to be formed. The first drive waveform includes a first ejection pulse and an ink droplet reducing pulse for retrieving a portion of an ink droplet about to leave the nozzle. The first ejection pulse is equal in crest value to the ink droplet reducing pulse. Except when there are no ejection commands either immediately before or after the dot to be formed, an ejection pulse signal having the second drive waveform is used. The second drive waveform includes a second ejection pulse and an ejection stabilizing pulse for suppressing residual vibrations generated by the second ejection pulse. The second ejection pulse is equal in crest value to and shorter in pulse width than the first ejection pulse, and the ejection stabilizing pulse is equal in crest value to the first ejection pulse.

By this method, the second drive waveform having an ejection stabilizing pulse is used to eject an ink droplet smaller than or equal to 20 pl to form a dot in response to one of continuous print commands and/or during printing at high frequencies, and the first drive waveform having a droplet reducing pulse is used to eject an ink droplet smaller than or equal to 20 pl to form a dot in response to a discontinuous print command. Accordingly, an ink droplet smaller than or equal to 20 pl can be ejected stably during printing at high frequencies.

In this driving method, when T represents a one-way propagation time of a pressure wave along the ink channel, a pulse width of the first ejection pulse is substantially equal to T, a pulse width of the ink droplet reducing pulse is within a range of 0.2T to 0.3T, a time period between the first ejection pulse and the ink droplet reducing pulse is within a range of 0.4T to 0.6T, a pulse width of the second ejection pulse is within a range of 0.5T to 0.7T, a pulse width of the ejection. stabilizing pulse is within a range of 0.2T to 0.3T, and a time period between the second ejection pulse and the ejection stabilizing pulse is within a range of 2.0T to 2.2T.

By setting the pulse widths and the pulse applying timing in this way, differences between the first and second drive waveforms in ink droplet ejection velocity and volume are minimized. In addition, ejection stability is ensured in each printing condition to which the first or second drive waveform is applied.

According to another aspect of the invention, an ink jet apparatus that accomplishes the above-described method is provided. The ink jet apparatus includes a controller having a memory and an output device. The memory stores the first and second drive waveforms as ejection pulse signals, and the output device judges whether there are no ejection commands either immediately before or after a dot to be formed and, if so, applies an ejection pulse signal having the first drive waveform to the actuator and, if not so, applies an ejection pulse signal having the second drive waveform to the actuator.

According to still another aspect of the invention, a storage medium for storing a program that accomplishes the above-described method is provided. The program in the storage medium is loaded into a personal computer, or the like, from which print data is outputted to an ink jet apparatus to perform printing. The program accomplishes the function of generating first and second drive waveforms as ejection pulse signals, and the function of judging whether there are no ejection commands either immediately before or after a dot to be formed and, if so, applying an ejection pulse signal having the first drive waveform to the actuator and, if not so, applying an ejection pulse signal having the second drive waveform to the actuator.

BRIEF DESCRIPTION OF THE DRAWINGS

A preferred embodiment of the invention will be described with reference to the following figures wherein:

FIG. 5 is a table showing results of an ejection test performed to determine optimum conditions for drive waveform 1, according to the embodiment of the invention;

FIG. 6 is a table showing results of an ejection test performed to determine optimum conditions for drive waveform 2, according to the embodiment of the invention;

FIG. 7 is a table showing conditions of using the drive waveforms, according to the embodiment of the invention;

DETAILED DESCRIPTION OF EMBODIMENTS

Figure 1:
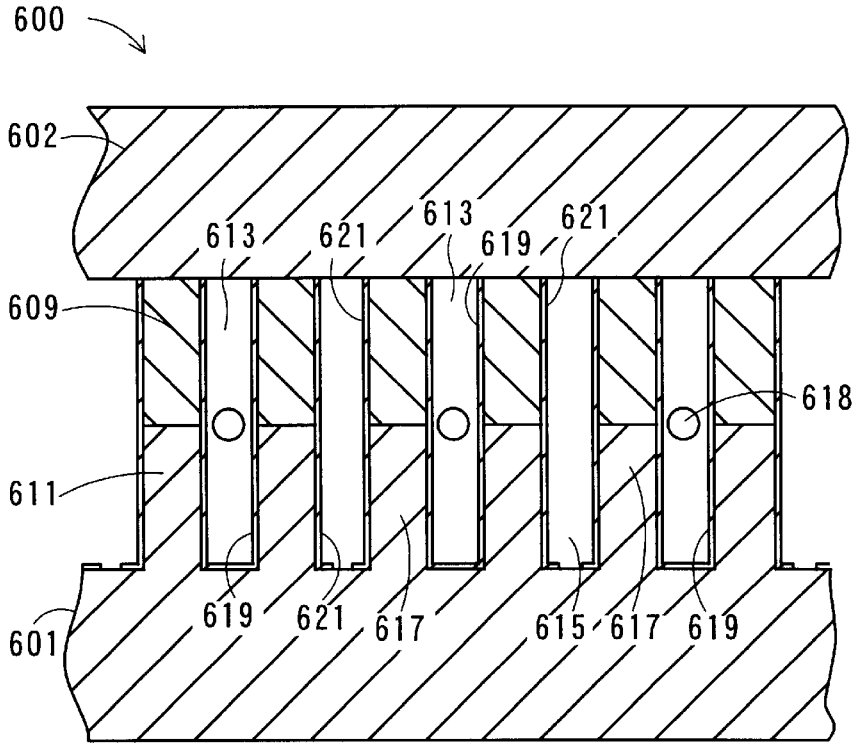
FIG. 1 is a sectional view of an ink jet head according to an embodiment of the invention.
Figure 2:
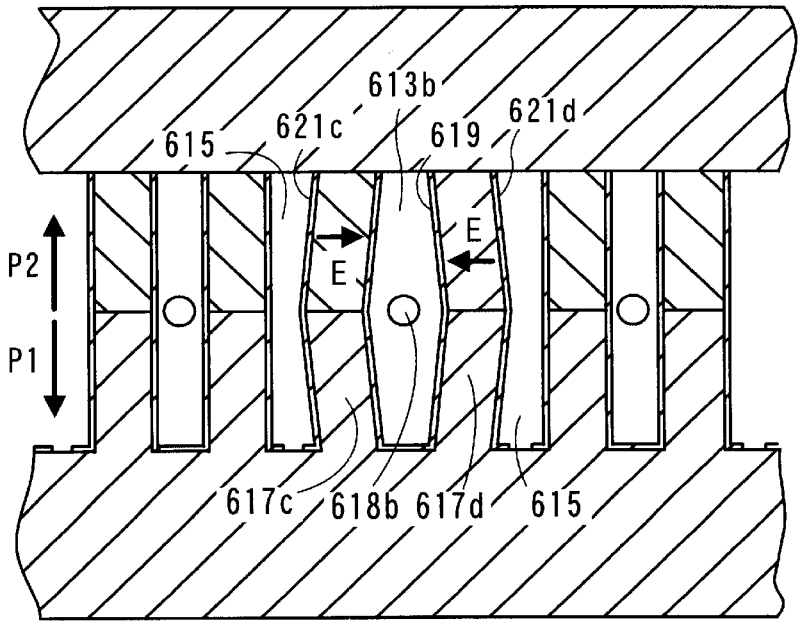
FIG. 2 illustrates actions of the ink jet head of FIG. 1.
Figure 3:
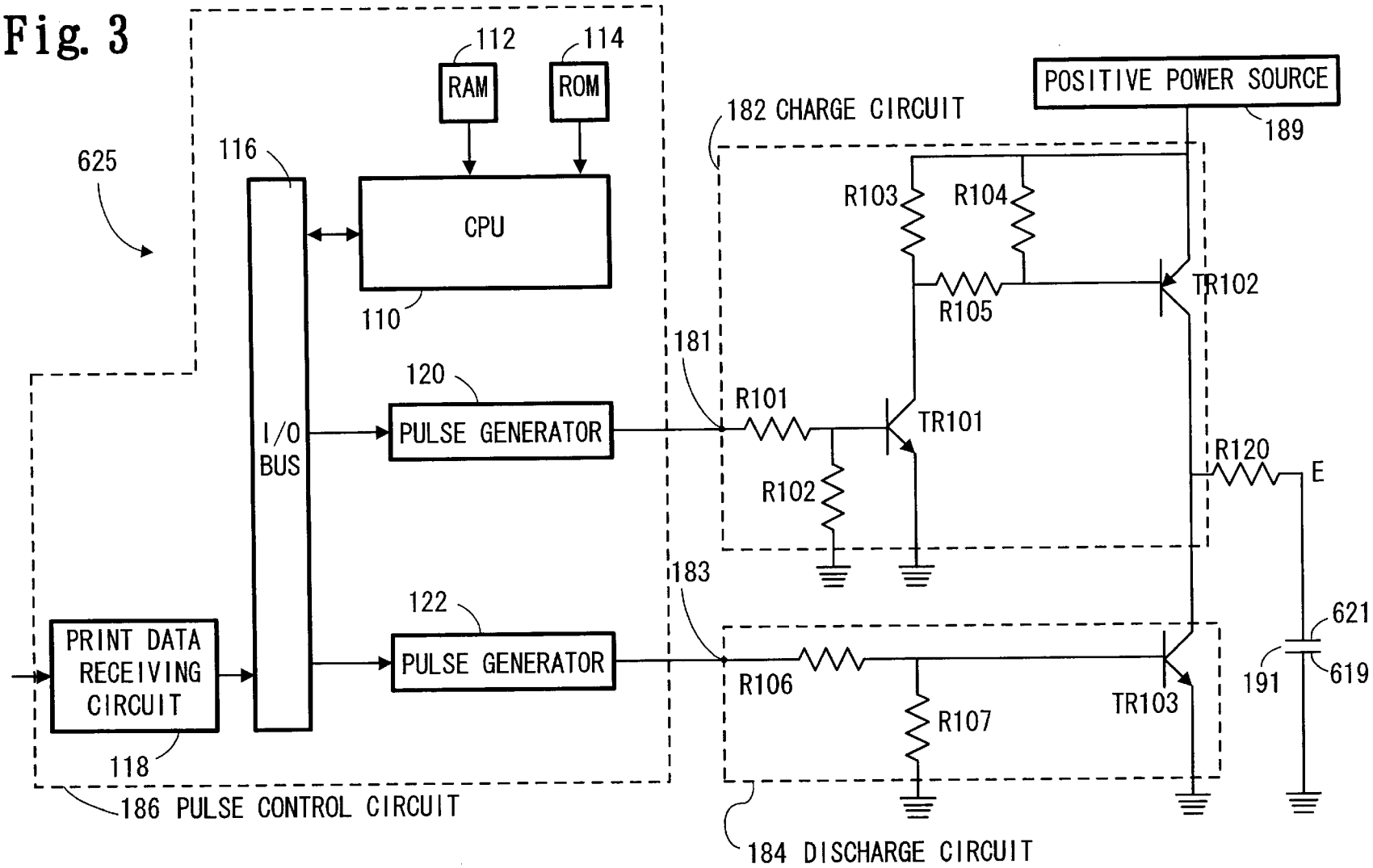
FIG. 3 shows a controller according to the embodiment of the invention.

One embodiment of the invention will be described with reference to the attached drawings. Referring first to FIGS. 1 through 3, the basic structure of an ink jet apparatus according to one embodiment of the invention will be described.

As a drop-on-demand type ink jet apparatus, a shear mode type using piezoelectric ceramic is disclosed in U.S. Pat. Nos. 4,879,568, 4,887,100, 5,028,936, and 6,257,686, all of which are incorporated herein by reference. FIG. 1 shows a sectional view of an exemplary shear mode type jet apparatus. An ink jet head 600 includes an actuator substrate 601 and a cover plate 602. Formed in the actuator substrate 601 are a plurality of ink channels 613, each shaped like a narrow groove and extending perpendicularly to the sheet of FIG. 1, and a plurality of dummy channels 615 carrying no ink. The ink channels 613 and the dummy channels 615 are isolated by sidewalls 617. Each sidewall 617 is divided into upper and lower halves, that is, an upper wall 609 polarized in direction P2 and a lower wall 611 polarized in direction P1. A nozzle 618 is provided at one end of each ink channel 613, and a manifold for supplying ink is provided at the other end thereof. Each dummy channel 615 is closed at the manifold-side end to block the entry of ink. Electrodes 619, 621 are provided, as metalized layers, on opposite side surfaces of each sidewall 617. More specifically, an electrode 619 in the ink channel 613 is disposed along the sidewall surfaces defining the ink channel 613. All electrodes 619 provided in the ink channels 613 are grounded. An electrode 621 in the dummy channel 615 is disposed on each of the sidewall surfaces defining the dummy channel 615. Two adjacent electrodes 621 provided in each dummy channel 615 are insulated from each other. Two adjacent dummy channel electrodes 621 disposed on sidewalls 617 opposite from an interposed ink channel 613 are electrically connected with each other, and also connected to a controller 625 of FIG. 3, which generates actuator driving signals.

When the controller 625 of FIG. 3 applies a voltage to two adjacent dummy channel electrodes 621 disposed on sidewalls 617 opposite from an interposed ink channel 613, the upper and lower walls 609, 611 of the two adjacent sidewalls 617 deform, by a piezoelectric shearing effect, in such directions that the volumetric capacity of the interposed ink channel 613 increases. For example, as shown in FIG. 2, when an ink channel 613*b* is driven, a voltage of E V is applied to two adjacent dummy channel electrodes 621*c*, 621*d*, disposed opposite from the interposed ink channel 613*b*, while all electrodes 619 in the ink channels are grounded. Consequently, electric fields are generated on sidewalls 617*c*, 617*d* in the directions of arrows E, and the upper and lower walls of the sidewalls 617*c*, 671*d* deform, by a piezoelectric shearing effect, in such directions that the volumetric capacity of the ink channel 613*b* is increased. At this time, the pressure within the ink channel 613*b*, including in the vicinity of the nozzle 618*b*, is reduced. By maintaining such a state for a period of time T required for one-way propagation of a pressure wave along the ink channel 613*b*, ink is supplied from the manifold (not shown) for that period of time.

The one-way propagation time T represents a time required for a pressure wave in the ink channel 613*b* to propagate longitudinally along the ink channel 613*b*, and is given by an expression T=L/Z, where L is a length of the ink channel 613*b*, and Z is a speed of sound in the ink in the ink channel 613*b*.

According to the theory of propagation of a pressure wave, when the time T has expired after the application of a voltage of E V, the pressure in the ink channel 613*b* is reversed to a positive pressure. Concurrently with the reversing of the pressure, the voltage applied to the electrodes 621*c*, 621*d* are reset to 0 V.

Then, the sidewalls 617*c*, 617*d* return to their original states (FIG. 1), and pressurize the ink. At this time, the pressure reversed to a positive pressure is combined with the pressure generated upon returning of the sidewalls 617*c*, 617*d*, and a relatively high pressure is generated in the vicinity of the nozzle 618*b* of the ink channel 613*b*. As a result, an ink droplet is ejected from the nozzle 618*b*.

More specifically, if a time period between applying a voltage of E V and resetting the voltage to 0 V does not agree with the one-way propagation time T, energy efficiency for ink ejection decreases. Particularly, when the time period between applying and resetting the voltage is even multiples of the one-way propagation time, no ink is ejected. When high energy efficiency is desired, for example, when actuation at a voltage as low as possible is desired, it is preferable that the time period between applying and resetting the voltage is equal to the one-way propagation time, or at least odd multiplies of the one-way propagation time.

Specific dimensions of the ink jet head 600 will be shown by way of example. The ink channel is 6.0 mm in length (L). The nozzle 618 is 26 $\mu$m in diameter on the ink ejecting side, 40 $\mu$m in diameter on the ink channel side, and 75 $\mu$m in length. When the temperature is 25° C., the viscosity of the ink used for an experiment was approximately 2 mPa·s and the surface tension thereof is 30 mN/m at 25° C. The ratio L/Z (=T) of the sound speed Z in the ink in the ink channel 613 to the ink channel length L is 9.0 μsec.

Figure 4A:
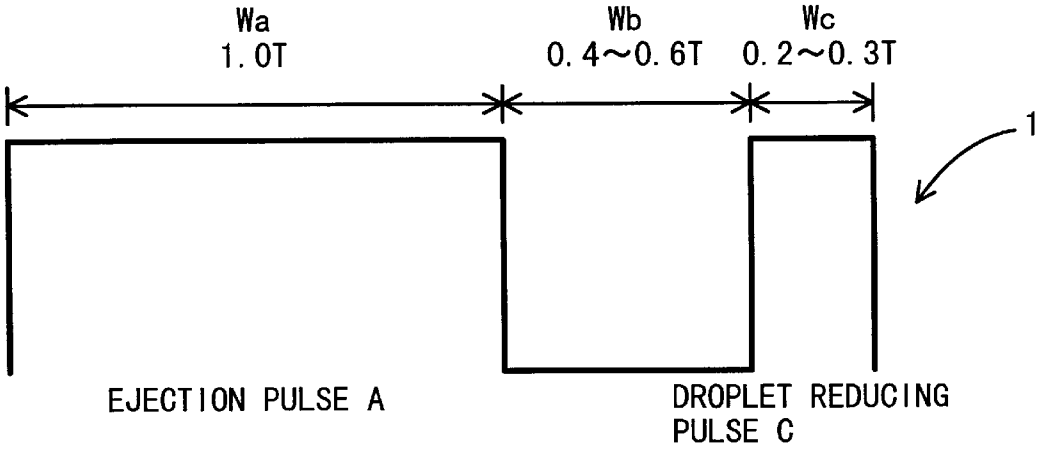
FIGS. 4A and 4B show drive waveforms for driving the ink jet apparatus according to the embodiment of the invention.

Drive waveform 1, shown in FIG. 4A, is a drive waveform for stably ejecting a minute ink droplet smaller than 20 pl (picoliters) in volume. Each numeric value added to drive waveform 1 indicates the ratio of a given period of time to the one-way propagation time T of a pressure wave in the ink channel 613.

Drive waveform 1 includes an ejection pulse A for ejecting an ink droplet and an ink droplet reducing pulse C for reducing the volume of the ink droplet ejected by the ejection pulse A. For example, by applying an ink droplet reducing pulse C to deform the sidewalls 617 and increase the volumetric capacity of the ink channel 613 before the ink droplet generated by the ejection pulse A leaves the nozzle 618, a portion of the ink droplet is retrieved into the ink channel 613 and the volume of the ink droplet to be ejected is reduced. Crest values (voltage values) of all these pulses are E V (for example, 17 V at 25° C.). The width Wa of ejection pulse A equals the one-way pressure wave propagation time T, that is, 9.0 μsec. The width Wc of ink droplet reducing pulse C equals 0.2 to 0.3 times the one-way pressure wave propagation time T, that is, 1.8 to 2.7 usec. A period of time Wb between ejection pulse A and ink droplet reducing pulse C equals 0.4 to 0.6 times the one-way pressure wave propagation time, that is, 3.6 to 4.5 μsec.

An experiment was conducted to determine appropriate timing for applying the pulses. The results of the experiment will now be described. As shown in a table in FIG. 5, when the width Wa of ejection pulse A was fixed to the one-way pressure wave propagation time T, the time. period Wb between ejection pulse A and ink droplet reducing pulse C was changed from 0.3 to 0.7 times the one-way pressure wave propagation time T, in increments of 0.05 times, and the width Wc of ink droplet reducing pulse C was changed from 0.1 to 0.4 times the one-way pressure wave propagation time T, in increments of 0.05 times. In each condition, the ink jet head 600 was continuously driven at a voltage of 17 V and at frequencies up to 7.5 kHz, and the ink ejecting state was observed and evaluated. O indicates a case where ink droplets smaller than 20 pl were stably ejected, Δindicates a case where ink droplets were ejected in a curve, and x indicates a case where ink droplets were ejected unstably and splashily.

It is clear from the evaluation results that ink droplets could be stably ejected when the time period between ejection pulse A and ink droplet reducing pulse C was set to 0.40 to 0.60 times the one-way pressure wave propagation time T and the width Wc of ink droplet reducing pulse C was set to 0.20 to 0.30 times the one-way pressure wave propagation time T. In these setting ranges, the ink droplet ejection velocity was approximately 6.0 m/s and the ink droplet ejection volume was approximately 15 pl.

Ink ejection using drive waveform 1 became unstable at printing frequencies higher than 7.5 kHz and printing at a frequency as high as 10 or 15 kHz was a failure when continuous dots were printed.

Figure 4B:
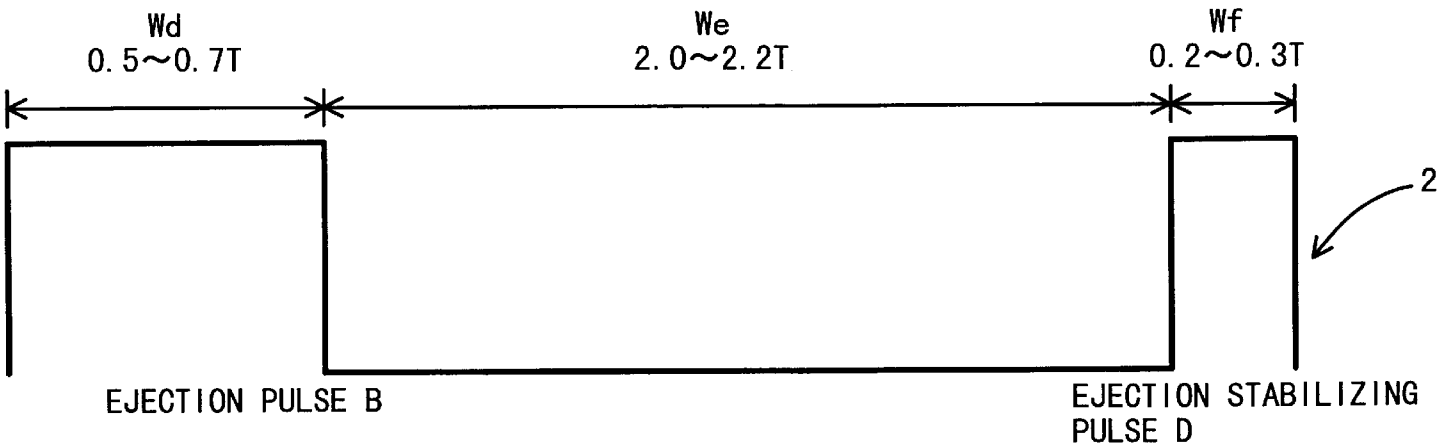

Drive waveform 2, shown in FIG. 4B, is a drive waveform for stably ejecting a minute ink droplet smaller than 20 pl (picoliters) in volume. Each numeric value added to drive waveform 2 indicates the ratio of a given period of time to the one-way propagation time T of a pressure waveform in the ink channel 613. Drive waveform 2 includes an ejection pulse B for ejecting an ink droplet and an ejection stabilizing pulse D for suppressing pressure vibrations in the ink channel 613 generated by ink ejection by the ejection pulse B. For example, fluctuations in pressure in the ink channel 613 are controlled by applying an ejection stabilizing pulse D so that the sidewalls 617 are deformed to increase the volumetric capacity of the ink channel 613 when the pressure in the ink channel 613 is increased, and so that the sidewalls 617 are returned to their original state when the pressure in the ink channel 613 is reduced.

Crest values (voltage values) of all these pulses are E V (for example, 17 V at 25° C). The width Wd of ejection pulse B equals 0.5 to 0.7 times the one-way pressure wave propagation time T, that is, 4.5 to 6.3 μsec. The width Wf of ejection stabilizing pulse C equals 0.2 to 0.3 times the one-way pressure wave propagation time T, that is, 1.8 to 2.7 μsec. A period of time We between ejection pulse B and ejection stabilizing pulse D equals 2.0 to 2.2 times the one-way pressure wave propagation time, that is, 18.0 to 19.8 μsec.

An experiment was conducted to determine appropriate timing for applying the pulses, and results of the experiment will now be described. The width Wd of ejection pulse B was set to 0.5 to 0.7 times the one-way propagation time so that the ink droplet ejection velocity and volume attained by drive waveform 2 would be as close as possible to those attained by drive waveform 1 when the drive voltage remained the same. If the width Wd of ejection pulse B is set to agree with the one-way pressure wave propagation time T, the ink droplet ejection velocity and volume become excessive because drive waveform 2 lacks a pulse for retrieving the ink about to be ejected into the ink channel, i.e., a droplet reducing pulse. By setting the width Wd of ejection pulse B to 0.5 to 0.7 times the one-way pressure wave propagation time T and by using the same drive voltage, with which drive waveform 1 attained an ink droplet ejection velocity of 6.0 m/s and an ink droplet ejection volume of 15 pl, drive waveform 2 could attain an ink droplet ejection velocity of 6.0 to 6.5 m/s and an ink droplet ejection volume of 15 to 19 pl, which are close to those attained by the waveform 1.

As shown in a table in FIG. 6, the width Wd of ejection pulse B was fixed at various values in the range 0.5–0.7T, T being the one-way pressure wave propagation time, during the experimentation, the time period We between ejection pulse B and ejection stabilizing pulse D was changed from 1.85 to 2.35 times the one-way pressure wave propagation time T, in increments of 0.05 times, and the width Wf of ejection pulse D was changed from 0.1 to 0.4 times the one-way pressure wave propagation time T, in increments of 0.05 times. In each condition, the ink jet head 600 was continuously driven at a voltage of 17 V and at frequencies of 10 to 15 kHz, and the ink ejecting state was observed and evaluated. O indicates a case where ink droplets smaller than 20 pl were stably ejected, Δ indicates a case where ink droplets were ejected in a curve, and x indicates a case where ink droplets were ejected unstably and splashily.

It is clear from the evaluation results that ink droplets could be stably ejected when the time period We between ejection pulse B and ink droplet reducing pulse D was set to 2.0 to 2.2 times the one-way pressure wave propagation time T and the width Wf of ejection stabilizing pulse D was set to 0.20 to 0.30 times the one-way pressure wave propagation time T. In these setting ranges, the ink droplet ejection velocity was approximately 6.3 m/s and the ink droplet ejection volume was approximately 18 pl.

More stable ink ejection was achieved at high printing frequencies by drive waveform 2 than by drive waveform 1.

However, the ink ejection volume attained by drive waveform 2 was increased 20% compared to that attained by drive waveform 1. How to advantageously use drive waveform 1, which ensures ejection of a minute ink droplet at low printing frequencies, and drive waveform 2, which slightly increases the ink ejection volume but ensures stable ink ejection even at high printing frequencies, will be described below.

When dots are formed to overlap each other on a print medium in response to continuous print commands, each dot cannot be distinguishable. In this case, increases in ink droplet ejection volume and dot diameter do not much matter. Thus, drive waveform 2, which slightly increases the volume of an ink droplet ejected to form a dot but ensures stable ink ejection even at high printing frequencies, is suitable when a print command for forming a dot is issued as one of continuous print commands. On the other hand, when dots are formed at intervals in response to discontinuous print commands, each dot should not exceed a required volume of ink so as to be distinguishable as a dot. Thus, in this case, drive waveform 1 is suitable because it ensures ejection of a minute ink droplet to form a dot apart from other dots when printing is performed at substantially low frequencies. Drive waveform 1, though, destabilizes ejection of an ink droplet when dots are continuously printed at high frequencies.

Accordingly, as shown in FIG. 7, when there are no print commands for forming adjacent dots either immediately before or after a dot to be formed, drive waveform 1 is used to eject an ink droplet to form the dot. When there is a print command for forming an adjacent dot either immediately before or after a dot to be formed, that is, when ink droplets are continuously ejected, drive waveform 2 is used to eject an ink droplet to form the dot. By doing so, an ink droplet is ejected stably at printing frequencies as high as 10 to 15 kHZ and, as a result, high-speed and high-resolution printing can be achieved.

As described above, when a dot is formed from an ink droplet smaller than 20 pl in volume, in response to one of continuous print commands, drive waveform 2 having an ejection stabilizing pulse D is used to eject an ink droplet. Use of drive waveform 2 is beneficial regardless of the ink droplet volume of an immediately preceding or following dot, which may be 20 pl or other than 20 pl . When a dot is formed from an ink droplet smaller than 20 pl in volume in response to a discontinuous print command, drive waveform 1 having an ink droplet reducing pulse C is used to eject an ink droplet. Selective use of these drive waveforms allows stable ink ejection even at high printing frequencies.

In the above-described embodiment, whether there is an print command immediately before and after a dot to be formed, that is, whether an adjacent dot is printed immediately before and after a dot to be formed, is judged by checking print commands line by line prior to application of ink ejection pulse signals to the actuator. Accordingly, after ink ejection pulse signals having different waveforms for printing each line have been determined, the ink ejection pulses are applied to the actuator.

In case that the print commands include commands to print various sizes of dots, namely, ink droplets in various volumes are requested to be ejected, the selection between the drive waveform 1 and the drive waveform 2, as described in the above embodiment, is used when it is judged that an ejection of an ink droplet smaller than or equal to 20 pl in volume is requested based on the print commands and it is confirmed that such a small ink droplet ejection is requested.

In the above-described embodiment, the appropriate timing for applying various pulses were determined from the results of experiments. In each experiment, the ink ejecting performance was evaluated by observing printouts with the unaided eye. A loupe or a microscope may be used to perform a more precise evaluation. However, for evaluating printouts produced by an ink jet head of an ink jet apparatus, an unaided visual evaluation is considered to be practically sufficient.

Whether ink ejection is curved in a scanning direction, that is, in an ink jet head moving direction, was evaluated with the unaided eye by comparing between a printout, produced by ink ejection from all nozzles while moving an ink jet head in the scanning direction, and a reference printout with satisfactory print quality.

Whether ink ejection is curved in a sub-scanning direction, that is, in a paper feed direction, was evaluated with the unaided eye by comparing between a printout, produced by ink ejection from selected nozzles while moving an ink jet head and a sheet of paper, and a reference printout with satisfactory print quality. A curve in ink ejection not less than approximately 20 $\mu$m was recognizable with the unaided eye.

Whether ink ejection is splashy was evaluated by observing an printout with the unaided eye to see if a splash of ink was recognizable.

Figure 9A:
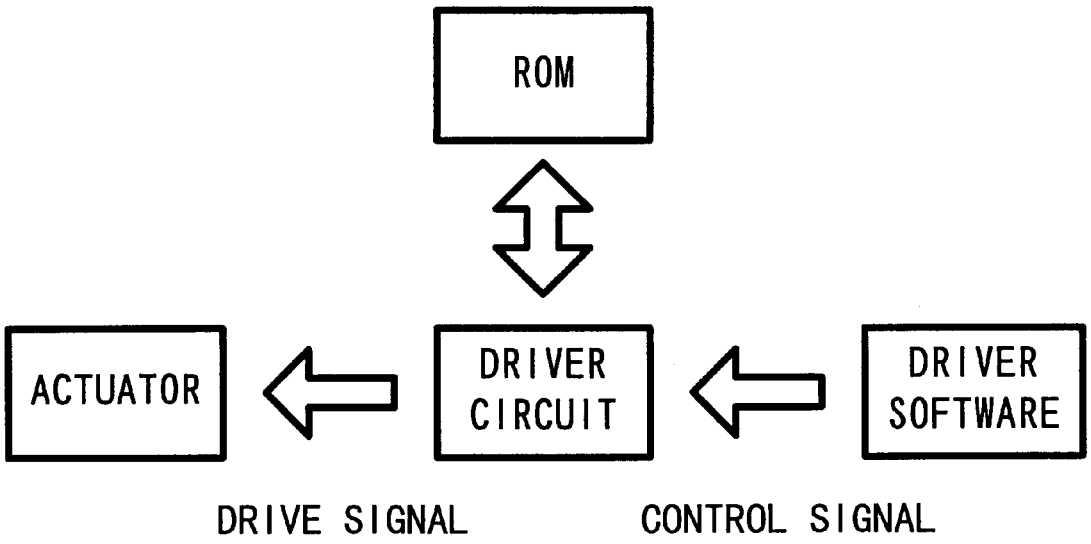
FIGS. 9A and 9B are functional block diagrams showing alternative flows of a print command.
Figure 9B:
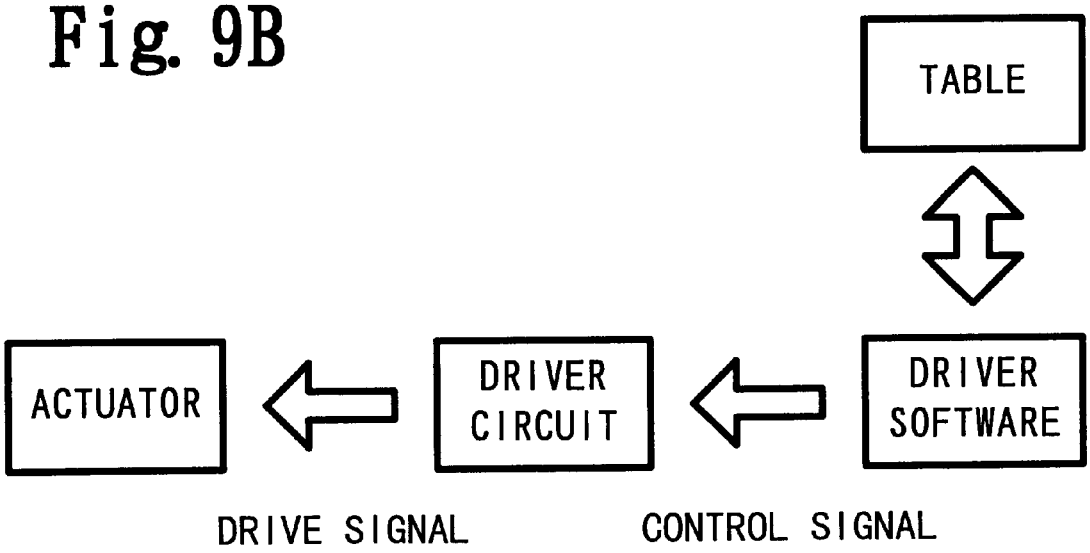

Referring now to FIGS. 3, 9A and 9B, a controller for generating the above-described drive waveforms, according to the embodiment of the invention, will be described. A controller 625, shown in FIG. 3, includes a charge circuit 182, a discharge circuit 184, and a pulse control circuit 186. The sidewall 617 made of piezoelectric material and the electrodes 619 and 621 are equivalent to a condenser 191.

Input terminals 181, 183 input pulse signals for applying voltages of E V and 0 V respectively to the electrode 621 in the dummy channel 615. The charge circuit 182 includes resistances R101–R105 and transistors TR101, TR102.

When an ON signal (+5 V) is inputted to the input terminal 181, the transistor TR101 is brought into conduction via the resistance R101, and a current flows from a positive power source 189, via the resistance R103, to a collector and then to an emitter of the transistor TR101. Thus, partial pressure applied to the resistances R104, R105, which are connected to the positive power source 189, increases, and a larger current flows into a base of the transistor TR102. Then, a collector and an emitter of the transistor TR102 is brought into conduction. For example, a voltage of 16 V from the positive power source 189 is applied to the condenser 191, via the collector and the emitter of the transistor TR102, and the resistance R120.

The discharge circuit 184 will now be described. The discharge circuit 184 includes resistances R106, R107 and a transistor TR1O3. When an ON signal (+5 V) is inputted to the input terminal 183, the transistor TR1O3 is brought into conduction via the resistance RI 06. Then the terminal of the condenser 191 on the side of the resistance R120 is grounded via the resistance RI20. Thus, the charge applied to the sidewall 617 shown in FIGS. 1 and 2 is discharged.

Figure 8:
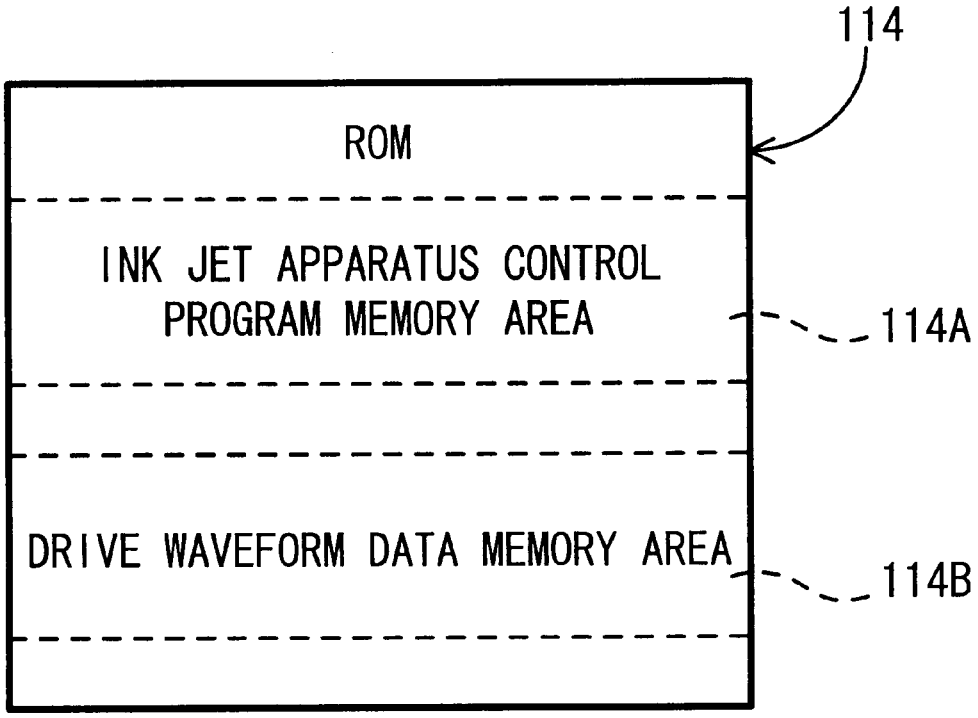
FIG. 8 is a diagram showing memory areas of the controller of FIG. 7.

The pulse control circuit 186, which generates pulse signals to be inputted to the input terminal 181 of the charge circuit 182 and the input terminal 183 of the discharge circuit 184, will now be described. The pulse control circuit 186 is provided with a CPU 110 that performs various computations. Connected to the CPU 110 are a RAM 112 for storing print data and various other data and a ROM 114 for storing a control program for the pulse control circuit 186 and sequence data for generating ON/OFF signals at a timed sequence. As shown in FIG. 8, the ROM 114 has a memory area 114A for an ink droplet control program and a memory area 114B for drive waveform data. The memory area 114B stores data on drive waveforms 1,2. The memory area 114A stores the table, shown in FIG. 7, indicating the correspondence between drive waveforms to be selected and ink ejecting conditions of immediately before and after a dot to be formed.

The CPU 110 is connected to an I/O bus 116 for exchanging various data. A print data receiving circuit 118 and pulse generators 120, 122 are connected to the I/O bus 116. An output terminal of the pulse generator 120 is connected to the input terminal 181 of the charge circuit 182, and an output terminal of the pulse generator 122 is connected to the input terminal 183 of the discharge circuit 184.

The CPU 110 controls the pulse generators 120, 121 according to the data stored in the control program memory area 114A and the drive waveform data memory area 114B of the ROM 114. Accordingly, the CPU 110 judges, upon receipt of data for printing a dot, whether there is ink ejection immediately before and/or after the dot to be printed and, based on the judgement, selectively outputs drive waveform 1 or 2.

It should be noted that the pulse generators 120, 122, the charge circuit 182, and the discharge circuit 184 are provided for each nozzle. In this embodiment, control of one nozzle is representatively described. Other nozzles are controlled in the same manner.

FIGS. 9A and 9B are functional block diagrams showing alternative flows of a print command. In FIG. 9A, a print command is supplied, as a control signal, by a personal computer, or the like, using driver software to a driver circuit. Based on the control signal, the driver circuit reads various data from the ROM 114 and generates a drive signal to drive an actuator. The driver circuit judges whether ink is ejected immediately before and/or after a dot to be printed. Then the driver circuit adjusts the drive waveform for the dot to be printed, as described above.

In FIG. 9B, a print command is converted to drive waveform 1 or 2 by a personal computer or the like using driver software with reference to the table in FIG. 7. The converted print command is supplied, as a control signal, to the driver circuit. Based on the control signal, the driver circuit generates a drive signal to drive the actuator. In this example, a storage medium for storing the table in FIG. 7 and drive waveform data is provided as the driver software.

While the invention has been described in connection with a specific preferred embodiment thereof, it should be understood that the invention is not limited to the above-described embodiment. For example, the ejection pulse, the ink droplet stabilizing pulse, and the ink droplet reducing pulse may be arbitrarily changed in width and number. Combinations of these pulses may be changed as well.

Although, in this embodiment, a shear mode actuator is used, another structure for generating a pressure wave, for example, by distortion of laminated piezoelectric material members in the laminating direction may be used. Materials other than piezoelectric material may be used if they generate a pressure wave in the ink channel.

According to the embodiment of the invention as described above, when a dot is formed by an ink droplet smaller than 20 pl in volume, in response to a discontinuous print command, drive waveform 1, which destabilizes ink ejection at high printing frequencies but ensures stable ejection of a minute ink droplet at low printing frequencies, is used. When a dot is formed in response to one of continuous print commands, drive waveform 2, which slightly increases the ink ejection volume but ensures stable ink ejection, is used to eject an ink droplet. By selectively using drive waveform 1 or 2, printing can be performed at high speed and at high resolution.

What is claimed is:

1. A method of driving an ink jet apparatus that comprises a nozzle from which an ink droplet is ejected, an ink channel filled with ink and connected to the nozzle, an actuator that changes a volumetric capacity of the ink channel to generate a pressure wave in the ink channel, and a controller that applies an ejection pulse signal to the actuator to cause ink droplet ejection from the nozzle, the driving method, which is applied when an ink droplet smaller than or equal to 20 pl in volume is ejected to form a dot, comprising:

ejecting an ink droplet to form the dot using an ejection pulse signal having a first drive waveform when there are no ejection commands either immediately before or after the dot to be formed, the first drive waveform including a first ejection pulse and an ink droplet reducing pulse for retrieving a portion of an ink droplet about to leave the nozzle, the first ejection pulse being equal in crest value to the ink droplet reducing pulse; and ejecting an ink droplet to form the dot using an ejection pulse signal having a second drive waveform except when there are no ejection commands either immediately before or after the dot to be formed, the second drive waveform including a second ejection pulse and an ejection stabilizing pulse for suppressing residual vibrations generated by the second ejection pulse, the second ejection pulse being equal in crest value to and shorter in pulse width than the first ejection pulse, and the ejection stabilizing pulse being equal in crest value to the first ejection pulse.

2. The driving method according to claim 1, wherein when T represents a one-way propagation time of the pressure wave along the ink channel, a pulse width of the first ejection pulse is substantially equal to T, a pulse width of the ink droplet reducing pulse is within a range of 0.2T to 0.3T, a time period between the first ejection pulse and the ink droplet reducing pulse is within a range of 0.4T to 0.6T, a pulse width of the second ejection pulse is within a range of 0.5T to 0.7T, a pulse width of the ejection stabilizing pulse is within a range of 0.2T to 0.3T, and a time period between the second ejection pulse and the ejection stabilizing pulse is within a range of 2.0T to 2.2T.

3. The driving method according to claim 1, wherein the ejecting step using an ejection pulse signal having the first drive waveform ejects an ink droplet to form the dot when the printing frequency is higher than 7.5 kHz and there is no dot before and after the dot to be formed.

4. The driving method according to claim 1, further comprising judging whether there is an ejection command to eject an ink droplet smaller than or equal to 20 pl in volume.

5. An ink jet apparatus, comprising:

a nozzle from which an ink droplet is ejected to form a dot;

an ink channel filled with ink and connected to the nozzle;

an actuator that changes a volumetric capacity of the ink channel to generate a pressure wave in the ink channel and cause ejection of the ink droplet from the nozzle; and a controller that applies an ejection pulse signal to the actuator to cause ejection of the ink droplet smaller than or equal to 20 pl in volume from the nozzle, the controller comprising:

a memory for storing a first drive waveform and a second drive waveform as ejection pulse signals, the first drive waveform including a first ejection pulse and an ink droplet reducing pulse for retrieving a portion of an ink droplet about to leave the nozzle, the first ejection pulse being equal in crest value to the ink droplet reducing pulse, the second waveform including a second ejection pulse and an ejection stabilizing pulse for suppressing residual vibrations generated by the second ejection pulse, the second ejection pulse being equal in crest value to and shorter in pulse width than the first ejection pulse, and the ejection stabilizing pulse being equal in crest value to the first ejection pulse; and an output device that judges whether there are no ejection commands either immediately before or after the dot to be formed and, if so, applies an ejection pulse signal having the first drive waveform to the actuator to form the dot and, if not so, applies an ejection pulse signal having the second drive waveform to the actuator to form the dot.

6. The ink jet apparatus according to claim 5, wherein the memory stores the first drive waveform and the second drive waveform such that when T represents a one-way propagation time of the pressure wave along the ink channel, a pulse width of the first ejection pulse is substantially equal to T, a pulse width of the ink droplet reducing pulse is within a range of 0.2T to 0.3T, a time period between the first ejection pulse and the ink droplet reducing pulse is within a range of 0.4T to 0.6T, a pulse width of the second ejection pulse is within a range of 0.5T to 0.7T, a pulse width of the ejection stabilizing pulse is within a range of 0.2T to 0.3T, and a time period between the second ejection pulse and the ejection stabilizing pulse is within a range of 2.0T to 2.2T.

7. The ink jet apparatus according to claim 5, wherein the output device applies an ejection pulse signal having the first drive waveform to the actuator to form the dot when a printing frequency is higher than 7.5 kHz and there is no dot before and after the dot to be formed.

8. The ink jet apparatus according to claim 5, wherein the output device judges whether there is an ejection command to eject any ink droplet smaller than or equal to 20 pl in volume.

9. A storage medium for storing a program for outputting an ejection pulse signal to an actuator of an ink jet apparatus so that the actuator changes a volumetric capacity of an ink channel filled with ink and connected to a nozzle to generate a pressure wave in the ink channel and cause ejection of an ink droplet smaller than or equal to 20 pl in volume from the nozzle to form the dot, the program accomplishing the functions of:

generating a first drive waveform and a second drive waveform as ejection pulse signals, the first drive waveform including a first ejection pulse and an ink droplet reducing pulse for retrieving a portion of an ink droplet about to leave the nozzle, the first ejection pulse being equal in crest value to the ink droplet reducing pulse, the second waveform including a second ejection pulse and an ejection stabilizing pulse for suppressing residual vibrations generated by the second ejection pulse, the second ejection pulse being equal in crest value to and shorter in pulse width than the first ejection pulse, and the ejection stabilizing pulse being equal in crest value to the first ejection pulse; and judging whether there are no ejection commands either immediately before or after the dot to be formed and, if so, applying an ejection pulse signal having the first drive waveform to the actuator to form the dot and, if not so, applying an ejection pulse signal having the second drive waveform to the actuator to form the dot.

10. The storage medium according to claim 9, further comprising data storage storing drive waveform data for each of the first drive waveform and the second drive waveform, wherein when T represents a one-way propagation time of the pressure wave along the ink channel, a pulse width of the first ejection pulse is substantially equal to T, a pulse width of the ink droplet reducing pulse is within a range of 0.2T to 0.3T, a time period between the first ejection pulse and the ink droplet reducing pulse is within a range of 0.4T to 0.6T, a pulse width of the second ejection pulse is within a range of 0.5T to 0.7T, a pulse width of the ejection stabilizing pulse is within a range of 0.2T to 0.3T, and a time period between the second ejection pulse and the ejection stabilizing pulse is within a range of 2.0T to 2.2T.

11. The storage medium according to claim 9, wherein the program accomplishes the function of applying an ejection pulse signal having the first drive waveform to eject ink droplets to form the dots when a printing frequency is higher than 7.5 kHz and there is no dot before and after the dot to be formed.

12. The storage medium according to claim 9, wherein the program accomplishes the function of judging whether there is an ejection command to eject an ink droplet smaller than or equal to 20 pl in volume.

13. A printing apparatus, comprising:

a printhead having:

at least one ink channel filled with ink;

a nozzle plate at one end of the printhead and having a nozzle for each ink channel of the at least one ink channel; and an actuating mechanism that varies a volume of an ink channel for ink ejection to print a dot; and a controller that controls ink ejection from the at least one ink channel to be about 20 pl or less by selecting one of a first drive waveform and a second drive waveform, the first drive waveform is used when no dot is printed before and no dot is to be printed after a current dot and the second drive waveform is used under all other print conditions, the first drive waveform comprising a first ejection pulse and an ejection reduction pulse and the second drive waveform comprising a second ejection pulse, different from the first ejection pulse, and an ejection stabilizing pulse.

14. The printing apparatus according to claim 13, wherein the crest value of each pulse is equal.

15. The printing apparatus according to claim 13, wherein when T represents a one-way propagation time of a pressure wave along the at least one ink channel, a pulse width of the first ejection pulse is substantially equal to T, a pulse width of the ejection reduction pulse is within a range of 0.2T to 0.3T, a time period between the first ejection pulse and the ejection reduction pulse is within a range of 0.4T to 0.6T, a pulse width of the second ejection pulse is within a range of 0.5T to 0.7T, a pulse width of the ejection stabilizing pulse is within a range of 0.2T to 0.3T, and a time period between the second ejection pulse and the ejection stabilizing pulse is within a range of 2.0T to 2.2T.

16. The printing apparatus according to claim 13, wherein the controller applies an ejection pulse signal having the first drive waveform to the actuating mechanism to form the dot when a printing frequency is higher than 7.5 kHz and there is no dot before and after the dot to be formed.

17. The printing apparatus according to claim 13, wherein the controller judges whether there is an ejection command to eject an ink droplet smaller than or equal to 20 pl in volume.

* * * * *